US010301870B2

(12) United States Patent
Kelly

(10) Patent No.: US 10,301,870 B2
(45) Date of Patent: May 28, 2019

(54) VENT

(75) Inventor: Frank Kelly, Defford (GB)

(73) Assignee: Bluewater Design Associates Limited, Droitwich, Worcestershire (GB)

( * ) Notice: Subject to any disclaimer, the term of this patent is extended or adjusted under 35 U.S.C. 154(b) by 368 days.

(21) Appl. No.: 12/998,500

(22) PCT Filed: Oct. 26, 2009

(86) PCT No.: PCT/EP2009/064062

§ 371 (c)(1),
(2), (4) Date: Jun. 17, 2011

(87) PCT Pub. No.: WO2010/060705

PCT Pub. Date: Jun. 3, 2010

(65) Prior Publication Data

US 2012/0028564 A1 Feb. 2, 2012

(30) Foreign Application Priority Data

Nov. 1, 2008 (GB) ..... 0820069.3
Jul. 9, 2009 (GB) ..... 0911934.8

(51) Int. Cl.

| | |
|---|---|
| ***F24F 7/00*** | (2006.01) |
| ***F24F 13/06*** | (2006.01) |
| ***F24F 13/08*** | (2006.01) |
| ***E06B 9/00*** | (2006.01) |
| ***E04B 1/70*** | (2006.01) |

(Continued)

(52) U.S. Cl.

CPC ..... *E06B 9/00* (2013.01); *E04B 1/7076* (2013.01); *E04C 1/392* (2013.01); *F24F 13/082* (2013.01); *F24F 13/20* (2013.01); *F24F 2007/003* (2013.01); *F24F 2221/52* (2013.01)

(58) Field of Classification Search

CPC ..... E04B 1/70; E04B 1/7076; F24F 13/08; F24F 7/00; F24F 13/082; F24F 13/20; E06B 9/00

USPC ..... 454/283; 405/100, 96, 104; 52/302.1, 52/69.5

See application file for complete search history.

(56) References Cited

U.S. PATENT DOCUMENTS 2,754,747 A * 7/1956 Bertling ..... F24F 13/075 454/309
5,586,934 A * 12/1996 Dombrowski ..... F24F 13/08 109/23

(Continued)

FOREIGN PATENT DOCUMENTS

AU 2008100183 A4 5/2008
GB 2 397 592 A 7/2004

(Continued)

OTHER PUBLICATIONS

International Search Report (7 sheets).

*Primary Examiner* — Helena Kosanovic
(74) *Attorney, Agent, or Firm* — Neil D. Gershon

(57) ABSTRACT

A vent comprises a vent body (1) having at least one air flow channel through the body between a front face and a rear face (2) of the body. At least one float controlled flap valve (13) is pivotably mounted within the body, the or each valve having a first, normal position in which air is permitted to flow through an air flow channel and a second position in which the valve pivots in the presence of water to seal the air flow channel.

14 Claims, 5 Drawing Sheets

(51) Int. Cl.
*E04C 1/39* (2006.01)
*F24F 13/20* (2006.01)

(56) References Cited

U.S. PATENT DOCUMENTS

| | | | | |
|---|---|---|---|---|
| 5,916,023 | A * | 6/1999 | Meyer | D06F 58/14 34/235 |
| 6,431,980 | B1 * | 8/2002 | Achen | F24F 13/084 454/271 |
| 6,485,231 | B2 * | 11/2002 | Montgomery et al. | 405/92 |
| 7,926,539 | B1 * | 4/2011 | Hurst | E05B 51/023 160/104 |
| 8,033,900 | B2 * | 10/2011 | Vanden Bosch | F24F 13/14 454/271 |
| 2005/0266791 | A1 * | 12/2005 | Beliveau | E04B 1/7076 454/271 |

FOREIGN PATENT DOCUMENTS

| | | | | |
|---|---|---|---|---|
| GB | 2 410 973 | A | 8/2005 | |
| GB | 2 457 374 | A | 8/2009 | |
| GB | 2461754 | A * | 1/2010 | E04B 1/7076 |
| WO | WO 02/08533 | | 1/2002 | |

* cited by examiner

VENT

This invention relates to a vent, for example to replace an air-brick.

It is well known in the construction industry to use air-bricks in buildings, for example in cavity walls, to allow air to circulate, for example under internal flooring. However, if the area around the building is flooded, water can enter the building through the air-bricks and the building can become flooded.

One solution to this problem is to erect a barrier, for example of sandbags, before the flood waters arrive so as to prevent the water reaching any openings, such as air-bricks, doors or other openings. However, such a solution is time consuming and labour intensive and requires the availability of sand and bags or pre-filled sandbags, as well as the construction of a protective wall from the sandbags. Moreover, further labour is required to remove the sandbags after the flood waters have receded.

Another solution is to fit a periscope-like device to an air-brick so as to raise the level of the air inlet point. However, as with sandbags, this solution requires adequate prior warning of approaching flood waters in order to fit the device and, once again, the device must be removed after the flood waters have receded.

It is known from GB-A-2 379 592 to provide a vent which resembles an air-brick in that it has an apertured front face, but is provided internally with a float-controlled valve in the form of a floating ball which closes the valve automatically in the event of a flood and opens again as the flood waters recede. A disadvantage of such a vent is that it is made of numerous different components, especially for mounting the float valves, which all require to be manufactured separately and then assembled to form the vent. The large number of components, and the labour involved in assembling them, all add to the cost of the vent and it is therefore desirable to provide a vent which is more simple and economical to manufacture.

It is therefore an object of the present invention to provide a vent which overcomes, or at least ameliorates, the disadvantages of known vents.

According to the present invention there is provided a vent comprising: a vent body; at least one air flow channel through the body between a front face and a rear face of the body; and at least one float controlled flap valve pivotably mounted within the body, the or each valve having a first, normal position in which air is permitted to flow through an air flow channel and a second position in which the valve pivots in the presence of water to seal the air flow channel.

The at least one flow channel may include one or more apertures provided in the front face and/or the rear face of the body. The edges of the aperture(s) may be chamfered.

The body may have an apertured plate covering the front and/or rear face thereof.

The or each aperture may be covered with a mesh to prevent insects and the like entering the body. The mesh may have a size of about 2 mm. The mesh at the front and/or rear face may be positioned between the apertured plate and the body, or may be secured to the plate by means of pins.

The float controlled flap valve may be pivotably mounted along a lower edge thereof. The valve may be mounted adjacent the rear face of the body. The valve may include a plate having a substantially planar face for engaging with the rear face of the body, for example so as to close the aperture(s) in the rear face. The plate may be provided with one or more closures projecting from the planar surface of the plate into the aperture(s) in the rear face. The edges of the projecting closure(s) may be chamfered. Alternatively, a gasket may be provided for sealing between the plate and the rear face. The gasket may be provided on the plate or the rear face. The valve may be pivotably mounted by means of pins extending laterally from a lower edge thereof. The pins may be part of a substantially cylindrical member extending along a lower edge region of the valve. The valve may include at least one float member, for example provided on that face of the plate remote from the planar face.

A plurality of apertures may be provided along a lower edge region of the plate to allow excess water to escape.

The rear face of the body may be inclined to the vertical such that the top of the rear face is closer to the front of the body than the bottom thereof. The rear face may be inclined at an angle in the range from about 20 degrees to about 30 degrees to the vertical. Preferably, the rear face is inclined at an angle of substantially 22.5 degrees to the vertical.

Thus, the present invention provides a vent which can be made from a small number of components and which substantially prevents the ingress of water into a building in the event of a flood.

For a better understanding of the present invention and to show more clearly how it may be carried into effect reference will now be made, by way of example, to the accompanying drawings in which.

Figure 1:
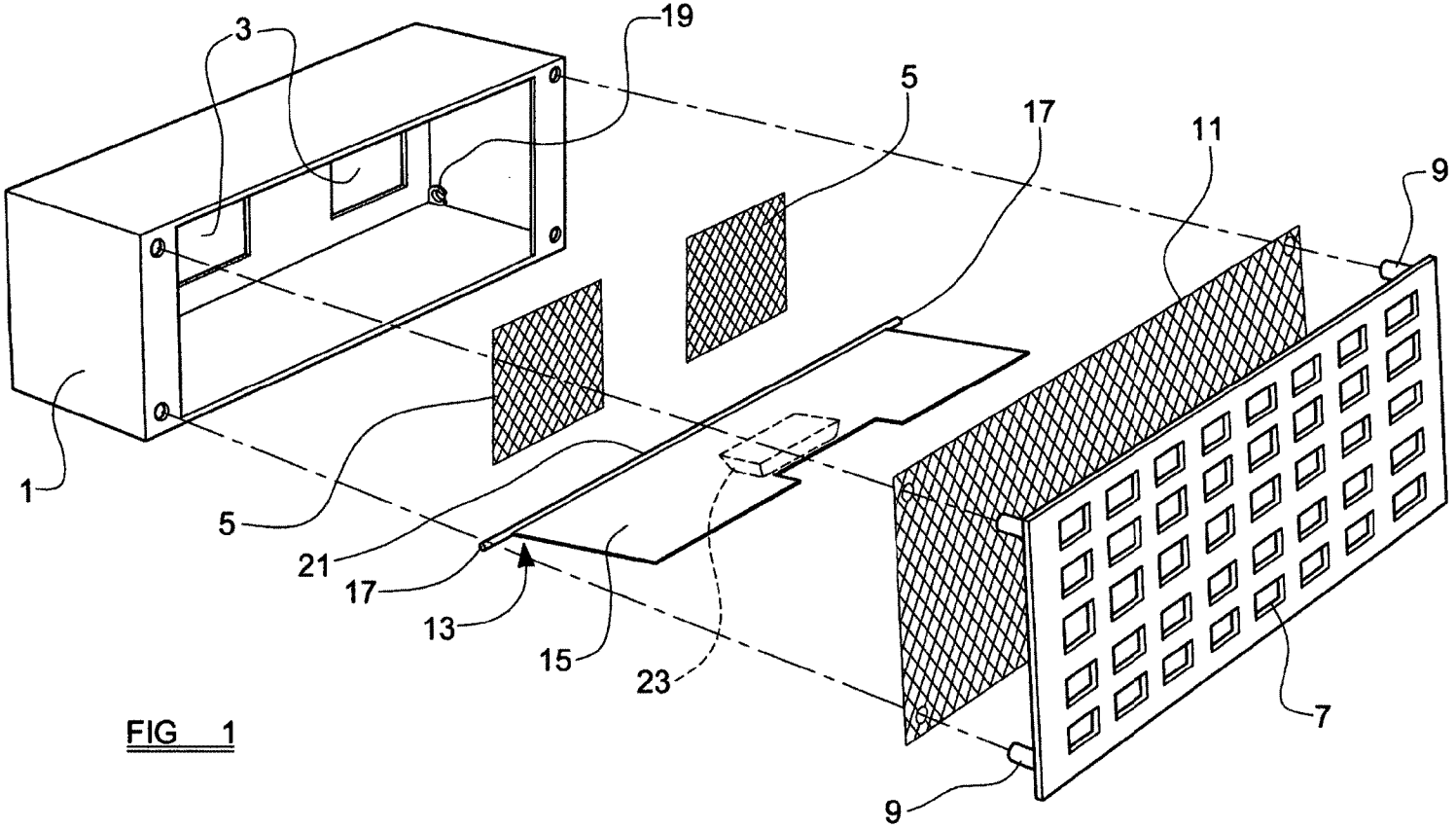
FIG. 1 is an exploded perspective view of one embodiment of a vent according to the present invention.
Figure 2:
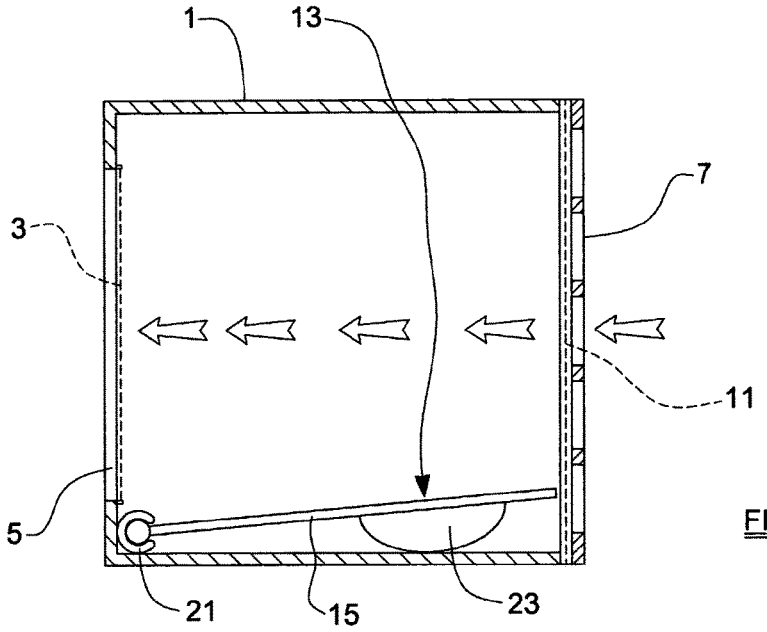
FIG. 2 is a sectional view showing the vent of FIG. 1 in its normal configuration.
Figure 3:
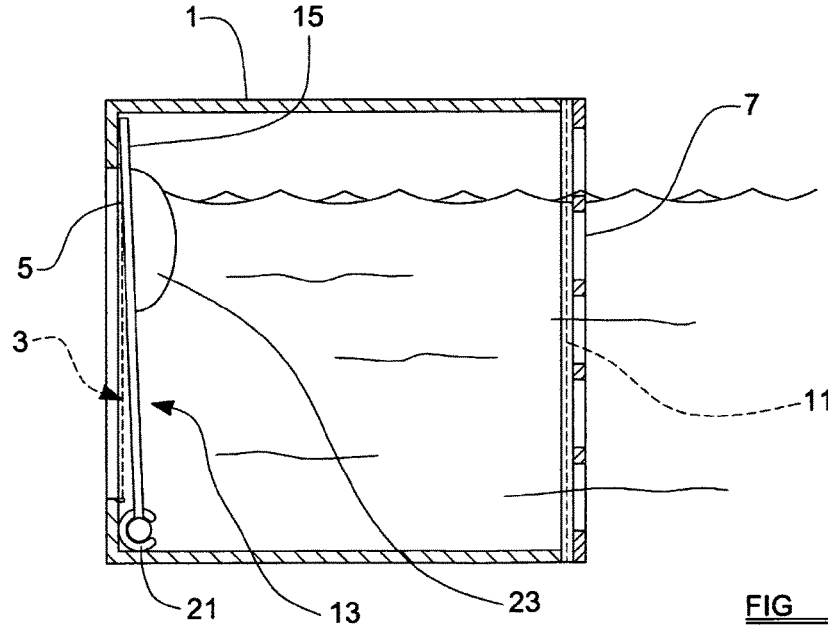
FIG. 3 is a sectional view corresponding to that of FIG. 2, but showing the vent in a configuration during a flood.

The vent shown in FIGS. 1 to 3 comprises a body 1 having dimensions substantially corresponding to those of an air-brick. The body may be made, for example, of polypropylene, and may be made by injection moulding. A rear face of the body is formed with one or more apertures 3, two rectangular apertures are shown in FIG. 1, which allow the passage of air into a building. The or each aperture 3 is covered, ideally internally of the body, with a mesh 5 to prevent insects or the like entering the body 1 through the aperture(s) 3. The mesh may comprise, for example, extruded high-density polyethylene or polypropylene mesh having a mesh size of about 2 mm so as to offer protection against small insects while allowing good fluid flow. As an alternative, the mesh may be made of other materials, such as suitable plastics or non-corroding metals. The mesh may be incorporated into the body during moulding of the body, or may be attached subsequently, for example by means of threaded fasteners or an adhesive.

A front face of the body 1 is substantially open and is covered with an apertured panel 7 which is secured to side walls of the body 1 by means of suitable fasteners 9, such as threaded fasteners. A further mesh 11, essentially the same as the mesh 5, is mounted between the apertured panel 7 and the body 1, retained in position by the fasteners 9. The apertured panel may be made of the same material as the body 1.

A valve member 13, effectively in the form of a float controlled flap valve, is mounted within the body 1 adjacent to the rear face of the body and comprises a plate 15 which has a substantially planar face for engaging with the rear face of the body so as to close the aperture(s) 3 in the rear face. If desired, the planar face of the plate 15 or the rear face of the body 1 may be formed with a gasket (not shown) for sealing between the rear face and the plate 15. The valve member 13 is pivotably mounted in the lower side walls of the body 1 by means of laterally-extending pins 17 which extend from a lower edge of the plate 15 into a recess 19 provided in each side wall. The pins 17 may form the ends of a substantially cylindrical member 21 which extends along the lower edge of the plate 15 so as to strengthen the plate. Alternatively, the plate 15 may be provided with alternative strengthening means, such as reinforcing ribs provided on that side of the plate opposite to the planar face. The valve member 13 also includes a float member 23 formed on that face of the plate opposite to the planar face. The float member 23 reduces the specific gravity of the valve member 13 to a value less than that of water, such that the valve member 13 tends to rise when immersed in water, although in practice this is confined to pivoting movement due to the engagement between the valve member 13 and the body 1. The valve member 23 may be made of the same material as the body 1, while the float member may be an air space or a foamed material provided within the material of the plate 15, for example as a bubble on that face of the plate remote from the planar face.

In use of the vent, the vent is incorporated into a wall of a building in the same manner as a conventional air-brick, with the apertured panel 7 to the outside of the building. In normal conditions, air can pass between the outside and inside of the building through the apertured panel and the aperture(s) 3 formed in the rear face of the body 1 as indicated by the arrows in FIG. 2. This is because, in the absence of water, the valve member 13 pivots downwardly to rest on the base of the body 1. However, in the event of flooding, ingress of water into the body 1 causes the float member 23 to rise which results in pivoting of the valve member 13 such that the planar face of the plate 15 bears against the rear face of the body 1 to seal the aperture(s) 3 and prevent the flow of water through the body and into the building. In addition the pressure of the flood water against the plate of the valve member 13 contributes to urging the plate against the rear face of the body and improves the seal between the plate and the body.

When the vent is intended for incorporation in a building during its construction, it may be preferred to provide at least some of the outer surfaces of the body 1 with external grooves, ribs, lands, or other surface features which will assist in anchoring the vent in the cement, mortar or mastic used to hold it in place. On the other hand, when the vent is intended for incorporation in an existing building, it may be preferable to provide the body 1 with substantially smooth outer surfaces so as to minimise the size of the opening required for insertion of the vent into the existing brickwork.

In the event of a flood, water may percolate through the soil beneath a building and cause dampness in any space below the ground floor. By temporarily removing the apertured panel 7 and mesh 11, a larger aperture is available to assist in drying out such dampness, for example by inserting air hoses into the body. Once the dampness has been reduced to acceptable levels, for example by blowing in the air, the mesh and apertured panel can be replaced.

Figure 4:
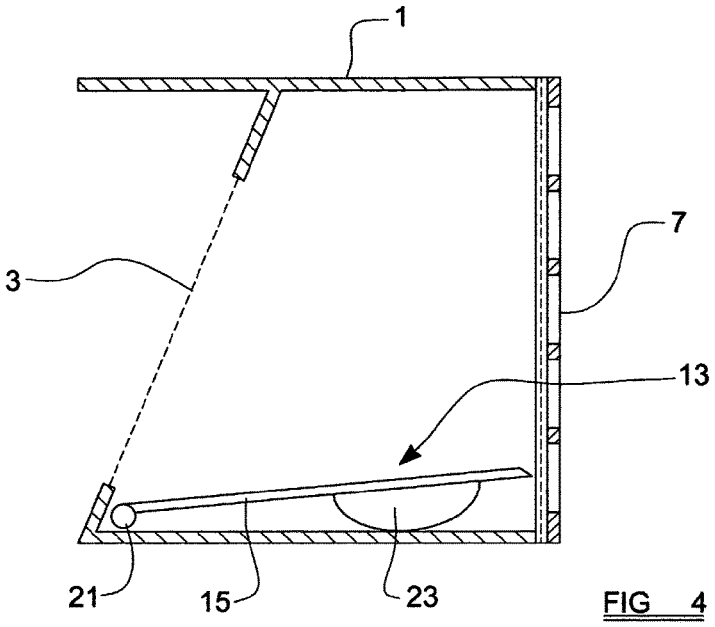
FIG. 4 is a sectional view of another embodiment of a vent according to the present invention.

The vent shown in FIG. 4 is similar to that shown in FIGS. 1 to 3 and the same references are used to denote the same or similar components. For convenience, some components, such as the meshes are not shown in FIG. 4. In the embodiment of FIG. 4 the rear face of the body 1 is inclined at an angle to the vertical such that the top of the rear face is closer to the front of the body than is the bottom thereof. The rear face may be inclined at an angle in the range from about 20 degrees to about 30 degrees, ideally substantially 22.5 degrees, to the vertical. The inclination of the rear face improves the seal between the body 1 and the plate 15.

Figure 5:
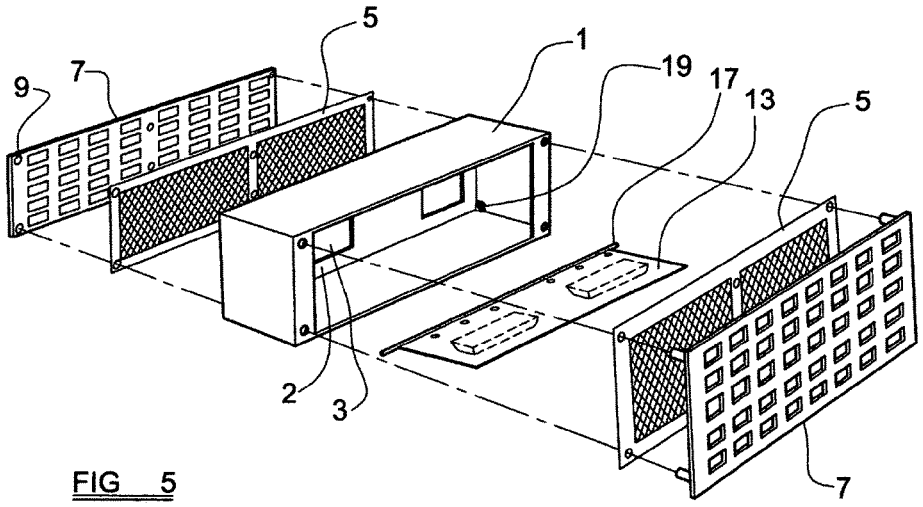
FIG. 5 is an exploded perspective view of another embodiment of a vent according to the present invention.
Figure 6:
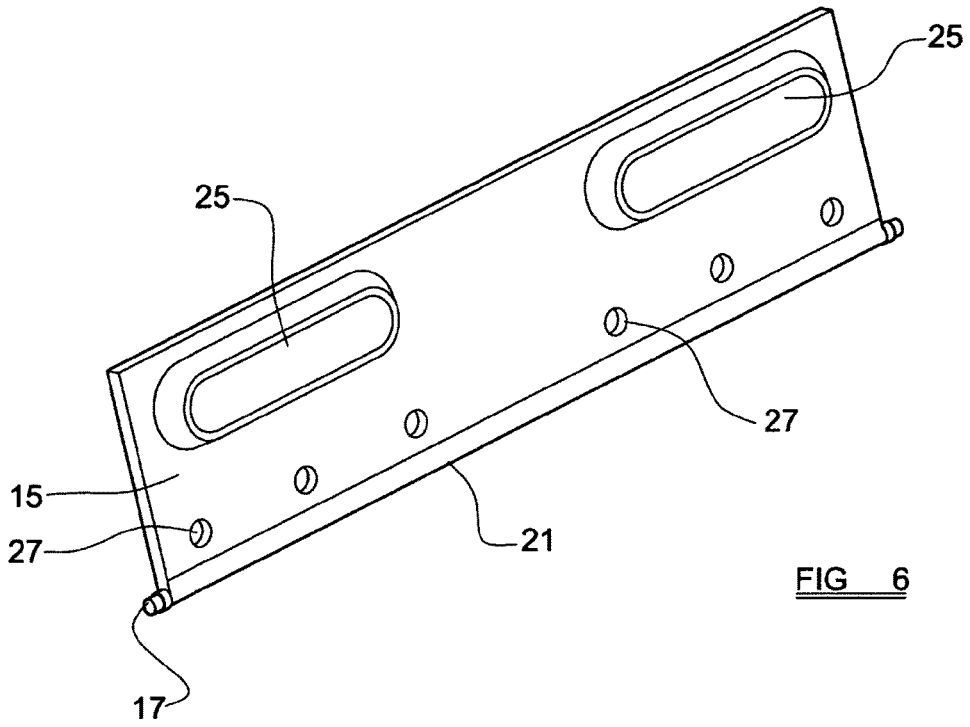
FIG. 6 is a perspective view in more detail of a valve member forming part of the vent shown in FIG. 5.
Figure 7:
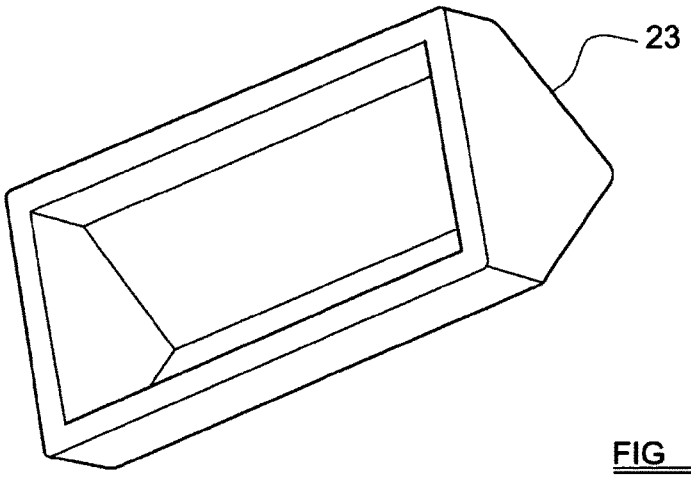
FIG. 7 is a perspective view of a float member forming part of the valve member shown in FIG. 6.

The vent shown in FIGS. 5 to 7 is similar to that shown in the previous figures and comprises a body 1 having a rear face 2 formed with two elongate apertures 3 which allow the passage of air into a building. The edges of the apertures may be chamfered for receiving closures as will be described in detail hereinafter. The rear face 2 is inclined at an angle of about 22.5 degrees to the vertical, with the top edge of the rear face being closer to the front of the body than the bottom thereof. The body 1 is a cuboid having a substantially rectangular cross section and presents front and rear edges which are covered with a mesh 5 to prevent insects or the like entering the body 1. The mesh may be a woven polyamide monofilament which is heat set and has about 14 threads per centimeter so as to offer protection against the passage of small insects while allowing good fluid flow.

The front and rear regions of the body are open and are each covered with an apertured panel 7 which is secured to walls of the body 1 by providing a stepped surface such that an inner region of the panel 7 projects beyond an outer region, the step engaging with the body 1. The mesh 5 is secured to the apertured panel by means of pins 9 which extend from the inner face of each panel 7 and pass through the mesh.

A valve member 13, effectively in the form of a float controlled flap valve, is mounted within the body 1 adjacent to the inclined rear face 2 of the body and on that side thereof facing the front of the body. The valve member 13 comprises a plate 15 which has a substantially planar face for engaging against the inclined rear face of the body and to cover the apertures 3 in the rear face. The valve member 13 is pivotably mounted in the lower side walls of the body 1 by means of laterally-extending pins 17 which extend from the lower edge of the plate 15 into a recess 19 formed in each side wall. The pins may form the ends of a substantially cylindrical member 21 which extends along the lower edge of the plate 15 so as to strengthen the plate. The plate 15 is also provided with a pair of aperture closures 25 which extend from the surface of the plate 15 and are dimensioned to fit closely within the apertures 3, the closures 25 having chamfered edges such that the cross-sectional area of each closure increases towards the plate and the projections provide an increasingly tight fit with the apertures 3 as the plate 15 moves in use towards the rear face of the body. The closures 25 may be of the same material as the remainder of the plate or may be of an elastomeric material such as EPDM rubber. A plurality of small apertures 27 are provided along the lower edge region of the plate 15 which allow any excess water between the plate 15 and the rear face of the body to escape as the plate 15 contacts the rear face 2.

The valve member 13 also includes a pair of float members 23, for example positioned on the opposite side of the plate 15 and in substantially the same location as the closures 25. The float members 23 are made separately and are secured to the plate 15 in an air tight manner with a waterproof adhesive. The float members may be made of the same material as the plate 15. The float members 23 reduce the specific gravity of the valve member 13 to a value less than that of water, such that the valve member 13 tends to rise when immersed in water, although in practice this is confined to pivoting movement due to engagement between the valve member 13 and the body 1.

Figure 8:
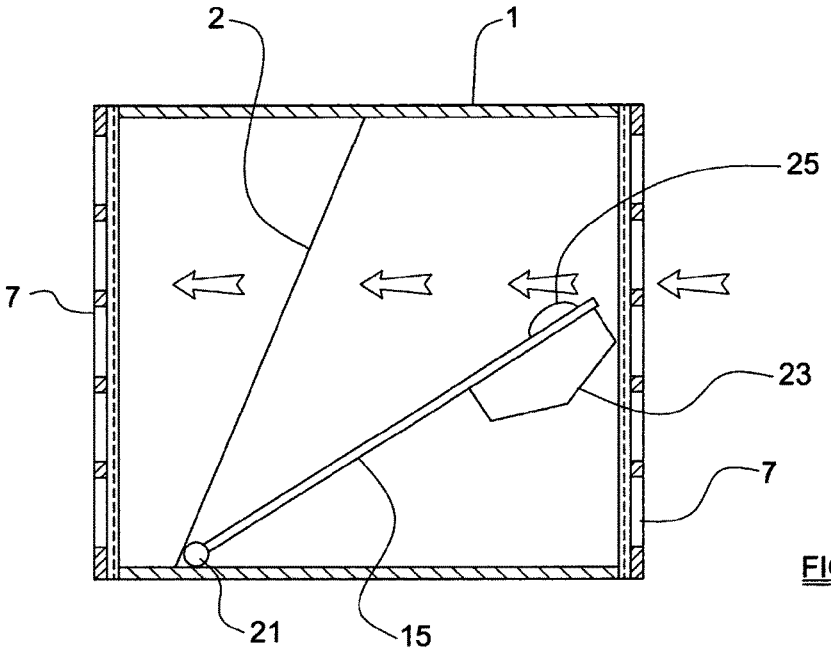
FIGS. 8 and 9 show the vent of FIGS. 5 to 7 in use.
Figure 9:
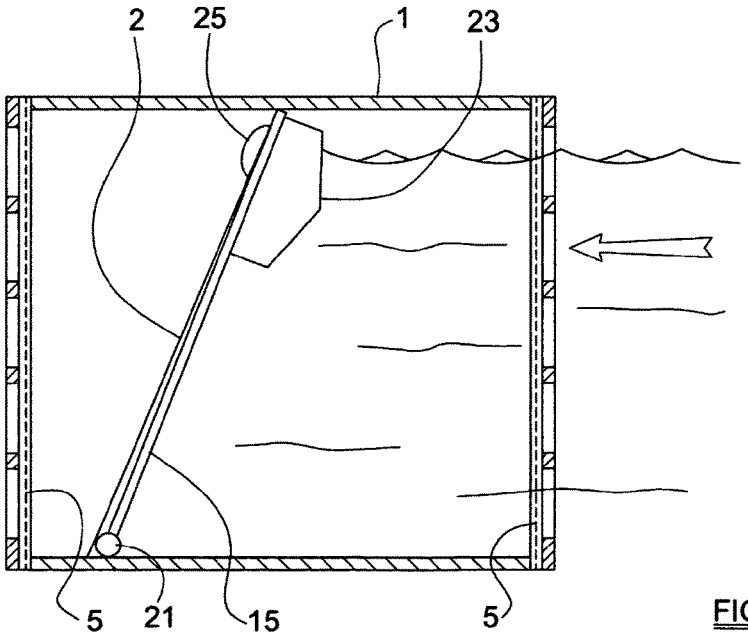

Use of the vent of FIGS. 5 to 7 is shown in FIGS. 8 and 9 and is essentially the same as the vent shown in FIGS. 1 to 3. FIG. 8 shows the vent in air and open, while FIG. 9 shows the vent in water and closed.

The invention claimed is:

1. A vent comprising: a vent body (1) having a front face, a rear face (2) and a wall joining the front and rear faces, at least one air flow channel through the body between the front face and the rear face (2) of the body, the at least one air flow channel including at least one aperture (3) provided in the rear face (2) of the body; and at least one float controlled flap valve (13) pivotably mounted within the body and spaced internal of the front of the body, the flap valve pivotably mounted at a bottom portion of the body, at least one valve having a first, normal position in which air is permitted to flow through the at least one air flow channel and a second position in which the valve pivots in the presence of water from its normal open position to a closed position to seal the air flow channel, wherein the valve (13) is mounted adjacent the rear face (2) of the body (1) and includes a plate (15) having a substantially planar face for engaging with the rear face (2) of the body (1), the plate (15) being provided with a plurality of spaced apart aperture closures (25) projecting rearwardly from the planar surface of the plate into the at least one aperture (3) in the rear face (2), the aperture closures being dimensioned to fit closely within the at least one aperture (3) and secure the plate to the rear face, the aperture closures (25) having chamfered edges so the cross-sectional area of the one or more aperture closures increasing toward the plate to provide an increasingly tight fit within the at least one aperture as the plate (15) moves toward the rear face (2) of the body (1) to prevent flow of water through the body, wherein the at least one aperture (3) includes a plurality of apertures in the rear face (2), the aperture closures provide an increasingly tight fit with the apertures (3) as the plate (15) pivots about a bottom hinge in use towards the rear face of the body from the normally open to the closed position to seal the channel, the aperture closures (25) spaced radially inwardly from outer edges of the plate (15).

2. A vent as claimed in claim 1, wherein the flap valve (13) is pivotably mounted by means of pins (17) extending laterally from a lower edge thereof.

3. A vent as claimed in claim 2, wherein the pins (17) are part of a substantially cylindrical member (21) extending along a lower edge region of the flap valve (13).

4. A vent as claimed in claim 1, wherein the flap valve (13) is pivotably mounted along a lower edge thereof and includes at least one float member (23) disposed near an upper edge thereof.

5. A vent as claimed in claim 4, wherein the at least one float member is provided on that face of the flap valve (13) remote from a sealing face thereof.

6. A vent comprising: a vent body (1); at least one air flow channel through the body between a front face and a rear face (2) of the body, the rear face (2) having a solid surface portion; and at least one float controlled flap valve (13) pivotably mounted within the body, the or each valve having a first, normal position in which air is permitted to flow through the at least one air flow channel and a second position in which the valve pivots in the presence of water to seal the air flow channel, wherein the valve (13) is mounted adjacent the rear face (2) of the body and includes a plate (15) having a substantially planar face for engaging with the rear face (2) of the body (1) and one or more aperture closures projecting into at least one aperture in the rear face, and wherein a plurality of water outflow apertures (27) are provided along a lower edge region of the flap valve (13) positioned below the one or more aperture closures and configured to allow excess water between the plate (15) and the rear face of the body to escape as the plate (15) contacts the rear face (2) and closes the plurality of apertures (3), wherein in a closed position of the plate, the plurality of water outflow apertures (27) dimensioned to enable escape of water, the water outflow apertures face the solid surface portion of the rear face so the rear face blocks passage of water through the plurality of apertures (27) after the plate has moved to the closed position.

7. A vent as claimed in claim 1, wherein the rear face (2) of the body (1) is inclined to the vertical such that the top of the rear face is closer to the front of the body than the bottom thereof.

8. A vent as claimed in claim 7, wherein the rear face (2) is inclined at an angle in the range from substantially 20 degrees to substantially 30 degrees to the vertical.

9. A vent as claimed in claim 8, wherein the rear face (2) is inclined at an angle of substantially 22.5 degrees to the vertical.

10. A vent as claimed in claim 1, wherein the flap valve (13) is pivotably mounted along a lower edge thereof and includes at least one float member (23) disposed near an upper edge thereof.

11. A vent as claimed in claim 10, wherein the at least one float member (23) is provided on that face of the flap valve (13) remote from a sealing face thereof.

12. A vent as claimed in claim 1, wherein the plurality of apertures (27) are provided along a lower edge region of the at least one flap valve (13) to allow excess water between the plate (15) and the rear face of the body to escape as the plate (15) contacts the rear face (2), the plurality of apertures positioned below the aperture closures (25).

13. A vent as claimed in claim 6, wherein the rear face (2) of the body (1) is inclined to the vertical such that the top of the rear face is closer to the front of the body than the bottom thereof.

14. A vent as claimed in claim 6, wherein the plurality of apertures (27) are unscreened.

* * * * *